US006759932B2

(12) United States Patent
Nishikawa

(10) Patent No.: US 6,759,932 B2
(45) Date of Patent: Jul. 6, 2004

(54) MAGNETIC SENSOR SWITCH

(75) Inventor: Kikuyoshi Nishikawa, Yokohama (JP)

(73) Assignee: Sagami Electric Co., Ltd., Kanagawa (JP)

( * ) Notice: Subject to any disclaimer, the term of this patent is extended or adjusted under 35 U.S.C. 154(b) by 121 days.

(21) Appl. No.: 10/057,802

(22) Filed: Jan. 23, 2002

(65) Prior Publication Data

US 2002/0113676 A1 Aug. 22, 2002

(30) Foreign Application Priority Data

Jan. 23, 2001 (JP) ..... 2001-014280

(51) Int. Cl.[7] ..... H01H 9/00
(52) U.S. Cl. ..... 335/205; 335/153; 335/207
(58) Field of Search ..... 335/205–207, 335/151–153; 340/547, 545.1

(56) References Cited

U.S. PATENT DOCUMENTS 5,155,460 A * 10/1992 Huckins et al. ..... 335/205
5,635,887 A * 6/1997 Fischette et al. ..... 335/205
5,877,664 A * 3/1999 Jackson, Jr. ..... 335/205

* cited by examiner

*Primary Examiner*—Lincoln Donovan
(74) *Attorney, Agent, or Firm*—David N. Lathrop, Esq.; Gallagher & Lathrop

(57) ABSTRACT

There is provided a magnetic sensor switch in which its magnetic sensor is responsive to approach of a magnet to turn its electrical switch on or off. A cylindrical magnetic sensor having magnetic poles contrary to each other at opposite ends thereof is mounted for rotation in clockwise and counter-clockwise directions. An auxiliary magnet is movably mounted on a longitudinal extension line of the magnetic sensor when the magnetic sensor is in the horizontal position so that the auxiliary magnet provides an attracting force and a repulsive force to the magnetic sensor to rotate it in one direction. The movement of the magnetic sensor is transmitted to a movable contact piece through a driving member to rotate the movable contact piece in one direction depending upon the rotation of the magnetic sensor. The movable contact piece is provided with a pair of contact blades one of which is contacted with one of a pair of fixed contact pieces disposed in opposition to the corresponding contact blades. First and second magnetic members are located at predetermined positions away from the two magnetic poles of the magnetic switch in order to enhance the instantaneous snap action when the magnetic sensor rotates.

4 Claims, 5 Drawing Sheets

PRIOR ART

MAGNETIC SENSOR SWITCH

BACKGROUND OF THE INVENTION

1. Field of the Invention

The present invention relates to a magnetic sensor switch that is operable in response to external magnetism to turn its contacts on and off, and more particularly, to a magnetic sensor switch of the type that comprises a magnetic sensor responsive to approach of a magnet, electrical contacts, and a driving member for transmitting the movement of the magnetic sensor to the electrical contacts, and is operable in response to the movement of the magnetic sensor to turn the electrical contacts on and off.

2. Description of the Related Art

As is disclosed in Japanese Patent Application Public Disclosure No. hei 6-347559 (347559/1994), for example, a magnetic sensor consisting of a combination of a permanent magnet and a reed switch responsive to magnetism has been heretofore known. As shown in FIG. 1, the magnetic sensor disclosed in the Japanese Patent Application Public Disclosure No. 347559/1994 comprises an elongated cylindrical case 71 made of a non-magnetic material, a reed switch 75 disposed in the interior of the case 71 generally in the center thereof, a columnar permanent magnet 73 mounted in the interior of the case 71 at the forward end (left-hand end as viewed in the drawing), a magnetic plate 87 attached to the outer side wall of the enclosure (glass tube in this example) 77 of the reed switch 75, and a magnetism adjusting permanent magnet 74 mounted at the peripheral area of the glass tube 77 adjacent one end thereof. The two permanent magnets 73 and 74 positioned on the opposite sides of the reed switch 75 are configured such that the opposing sides of the magnets 73 and 74 have the same magnetic polarity. In this example, the magnetic polarities of the opposing sides (the reed switch side) of the two magnets 73 and 74 are set both to be the S magnetic pole.

The reed switch 75 is positioned generally in the center of the case 71 by two spaced rings 76 and 78 both of which are made of heat resistant, electrical insulating material. The root portion of the case 71 is mounted to a sensor mounting base 95 by means of a bushing 91 made of rubber. Lead wires 96 and 99 leading out from reeds 93 and 94, both being made of a magnetic material, of the reed switch 75 are connected to suitable heat-resistant, insulated wires 89 and 90, respectively, that extend to the outside through the root portion of the case 71. As is well known, the forward ends of these reeds 93 and 94 comprise contact portions 79 acting as electrical contacts.

Next, the operation of the magnetic sensor constructed as described above will be briefly explained with reference to FIGS. 2 and 3. FIG. 2 shows magnetic lines of force generated from the magnetic sensor shown in FIG. 1 when the magnetic sensor is in the standby state in which there is no magnetic substance (object) or magnet in the vicinity around the sensor. From FIG. 2, it will be appreciated that there is a very weak magnetic field produced in the vicinity of the contact portions 79 of the reed switch 75. The distribution of the magnetic lines of force generated from the magnetic sensor during this standby state may be preliminarily adjusted by moving the magnetism adjusting permanent magnet 74 longitudinally of the case 71. When the magnetic field applied in the vicinity of the contact portions 79 of the reed switch 75 is relatively weak as shown in FIG. 2, the contact portions 79 remain open, and hence the reed switch 75 is in the off state.

As a magnetic substance or magnet approaches the vicinity of the magnetic sensor in the standby state, the magnetic field applied to the reed switch 75 changes. FIG. 3 shows magnetic lines of force generated from the magnetic sensor when two iron balls 97 and 98 being magnetic material approach the vicinity of the forward end of the reed switch 75. As is apparent from FIG. 3, the magnetic field in the vicinity of the contact portions 79 of the reed switch 75 is significantly intensified as compared with that in the standby state. As a result, the reeds 93 and 94 made of a magnetic material magnetically attract and contact each other, and hence the contact portions 79 go to on state. Further, the detailed construction, structure and operation of this magnetic sensor are disclosed in Japanese Patent Application Public Disclosure No. 347559/1994. Accordingly, further description thereof is omitted for purposes of convenience.

This magnetic sensor includes the magnetic plate 87 disposed in the vicinity of the contact portions 79 and the magnetism adjusting permanent magnet 74 positioned at the one end of the reed switch 75 near the base of the case, in addition to the permanent magnet 73, so that the magnetic field produced by the permanent magnet 73 in the vicinity of the contact portions 79 of the reed switch 75 may be adjusted by the magnetic plate 87 and the magnetism adjusting permanent magnet 74 to control the dynamic or operating sensitivity of the contact portions 79 of the reed switch 75.

As discussed above, this magnetic sensor is configured such that the magnetic field produced mainly by the permanent magnet 73 is applied directly to the reed switch 75 and the contact portions 79 of the reed switch 75 is controlled to turn on and off by that the applied magnetic field is varied by a magnetic substance or a magnet approaching the magnetic sensor. Otherwise stated, this is a magnetic switch of the type in which the magnetic field applied directly to the reed switch 75 is varied by an approaching magnetic substance or magnet whereby the opposing reeds 93 and 94 of the reed switch 75 are attracted to each other so that the contact portions 79 are controlled to the on position.

It is thus to be understood that the switch of this magnetic sensor would not be turned on unless there occurs a change in the magnetic field to some extent. Further, this magnetic sensor will be turned on, irrespective of the polarity of a magnet approaching the magnetic sensor and even if the approaching object is a magnetic substance or object rather than a magnet. For this reason, the illustrated prior art magnetic sensor can not be used in applications where the switch of the magnetic sensor is required to be turned on and off only when it is approached by a particular magnetic pole of a magnet.

In addition, because the prior art magnetic sensor as described above utilizes a reed switch, it has the disadvantages that the cost of manufacture is correspondingly increased and moreover, in the event of failure of the contact portions, the entire reed switch must be replaced, which leads to an increase in the maintenance cost.

SUMMARY OF THE INVENTION

An object of the present invention is to provide a magnetic sensor switch that does not utilize a switch having its contact portions to which a magnetic field is directly applied such as a reed switch.

Another object of the present invention is to provide a magnetic sensor switch in which its magnetic sensor causes its electrical switch to turn on and off in response to the approach of a particular magnetic pole of a magnet to the magnetic sensor.

In order to accomplish the foregoing objects, in one aspect of the present invention, a magnetic sensor switch is provided which comprises: an elongated magnetic sensor having magnetic poles contrary to each other at opposite ends thereof and mounted for rotation through predetermined angles in clockwise and counter-clockwise directions; a movable contact piece including a pair of contact blades; a pair of fixed contact pieces located in opposition to the pair of contact blades of the movable contact piece, respectively; a common contact piece electrically connected to the movable contact piece; a driving member transmitting the movement of the magnetic sensor to the movable contact piece; an auxiliary magnet located on a longitudinal extension line of the magnetic sensor and mounted such that it can be moved toward and away from one of the magnetic poles of the magnetic sensor; a first magnetic member located at a predetermined position outside of the rotating radius of the magnetic sensor and in the vicinity of the one magnetic pole; and a second magnetic member located at a predetermined position outside of the rotating radius of the magnetic sensor and in the vicinity of the other magnetic pole.

In one preferred embodiment, the aforesaid magnetic sensor is a generally cylindrical member comprising a cylindrical central body made of a magnetic substance, a first magnet affixed to the cylindrical central body at one of the opposite ends thereof, and a second magnet affixed to the cylindrical central body at the other of the opposite ends thereof; the aforesaid driving member comprises a movable contact piece driving section in the form of an elongated plate, and an actuating section formed integrally with the movable contact piece driving section and extending upwardly from one lateral side edge of the middle portion of the movable contact piece driving section; the aforesaid movable contact piece comprises an elongated electrically conductive plate-like member of a rectangular shape in a plan view, a tongue formed transversely in the central portion of the plate-like member, first and second contact blades formed in the longitudinal direction of the plate-like member in the opposite side regions adjoining the central portion of the plate-like member and extending in the opposite directions to each other, and generally circular depending portions depending from the opposite side edges of the central portion of the plate-like member; each of the aforesaid fixed contact pieces comprises a contact portion adapted to contact with the corresponding contact blade of the movable contact piece and a terminal portion formed integrally with and folded from the contact portion; and the aforesaid common contact piece comprises an elongated plate-like contact portion and a common terminal portion formed integrally with and folded from the contact portion, the contact portion of the common contact piece being formed with through-holes into which rotary shafts for rotatably supporting the magnetic sensor, the driving member, and the movable contact piece should be inserted, respectively.

The aforesaid magnetic sensor may be a generally cylindrical magnet having N magnetic pole at one of the opposite ends thereof and S magnetic pole at the other of the opposite ends thereof.

In addition, the aforesaid auxiliary magnet acts such that it provides an attracting force and a repulsive force to the one magnetic pole of the magnetic sensor to rotate the magnetic sensor through the predetermined angle in one direction, thereby to hold the magnetic sensor in standby position in which it is stationary at an inclined position tilted from the horizontal position, and the aforesaid first and second magnetic members act to provide attracting forces to the corresponding magnetic poles of the magnetic sensor thereby to impart an instantaneous snapping force to the magnetic sensor when the magnetic sensor rotates in a reverse direction.

With the construction of the present invention described above, since the provision of the first and second magnetic members adds a clicking action to the magnetic sensor, the rotating movement of the magnetic sensor may be instantaneously effected when it is reversed thereby to enable the instantaneous changeover of the switch. On top of that, fine adjustment of the distance between the magnetic sensor switch and an external magnet that the switch can detect the approach of the external magnet can be carried out, and hence it is possible to enhance the reliability of the magnetic sensor switch. In addition, because this magnetic sensor switch does not utilize a switch such as a reed switch having its contact portions to which a magnetic field is directly applied, the cost of manufacture can be reduced, and on top of that the maintenance cost can also be reduced.

BRIEF DESCRIPTION OF THE DRAWINGS

FIGS. 2 and 3 are diagrammatical views for explaining the operation of the prior art magnetic sensor shown in FIG. 1, wherein FIG. 2 shows magnetic lines of force generated from the magnetic sensor when the magnetic sensor is in the standby state and FIG. 3 shows magnetic lines of force generated from the magnetic sensor when the magnetic sensor has sensed a magnetic substance;

FIG. 6 shows the magnetic sensor used in the magnetic sensor switch shown in FIG. 4, wherein

FIG. 7 shows the lever used in the magnetic sensor switch shown in FIG. 4, wherein

FIG. 8 shows the movable contact piece used in the magnetic sensor switch shown in FIG. 4, wherein FIG. 9 shows one of the fixed contact pieces used in the magnetic sensor switch shown in FIG. 4, wherein

DETAILED DESCRIPTION OF THE PREFERRED EMBODIMENT

The preferred embodiment of the present invention will now be described in detail with reference to FIGS. 4 to 9. The present invention may, however, be embodied in many different forms and should not be construed as limited to the embodiment set forth hereinafter; rather, the embodiment is provided so that this disclosure will be thorough and complete, and will fully convey the scope of the invention to those skilled in the art.

Figure 1:
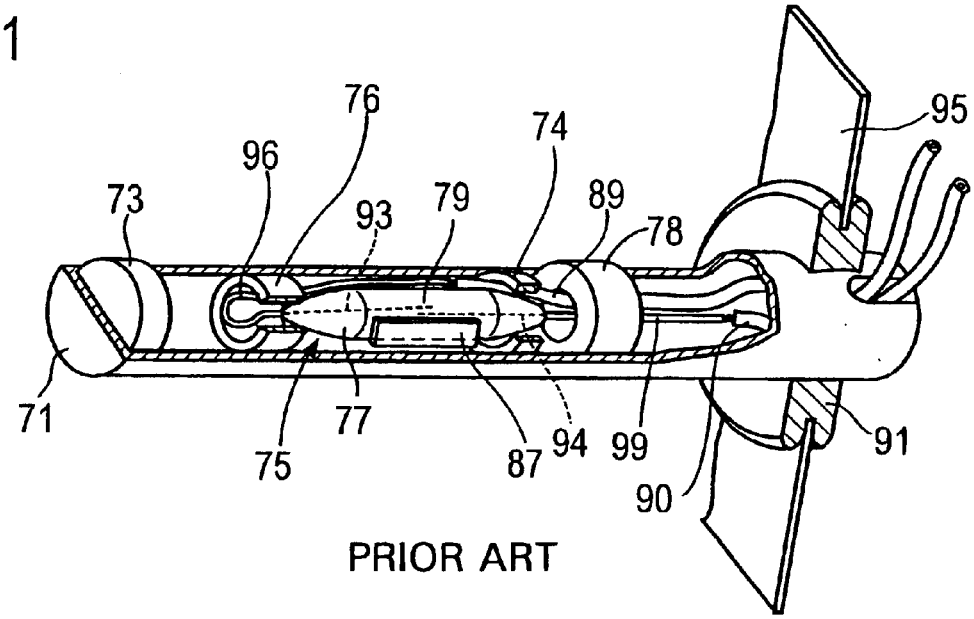
FIG. 1 is a perspective view, partly cut away, illustrating an example of the prior art magnetic sensor.
Figure 2:
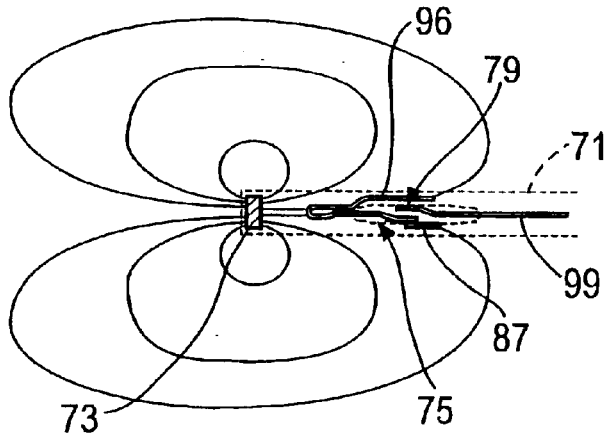
PRIOR ART FIG.2
Figure 3:
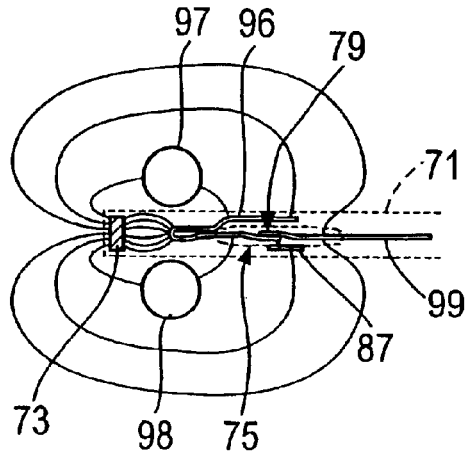
PRIOR ART FIG.3
Figure 4:
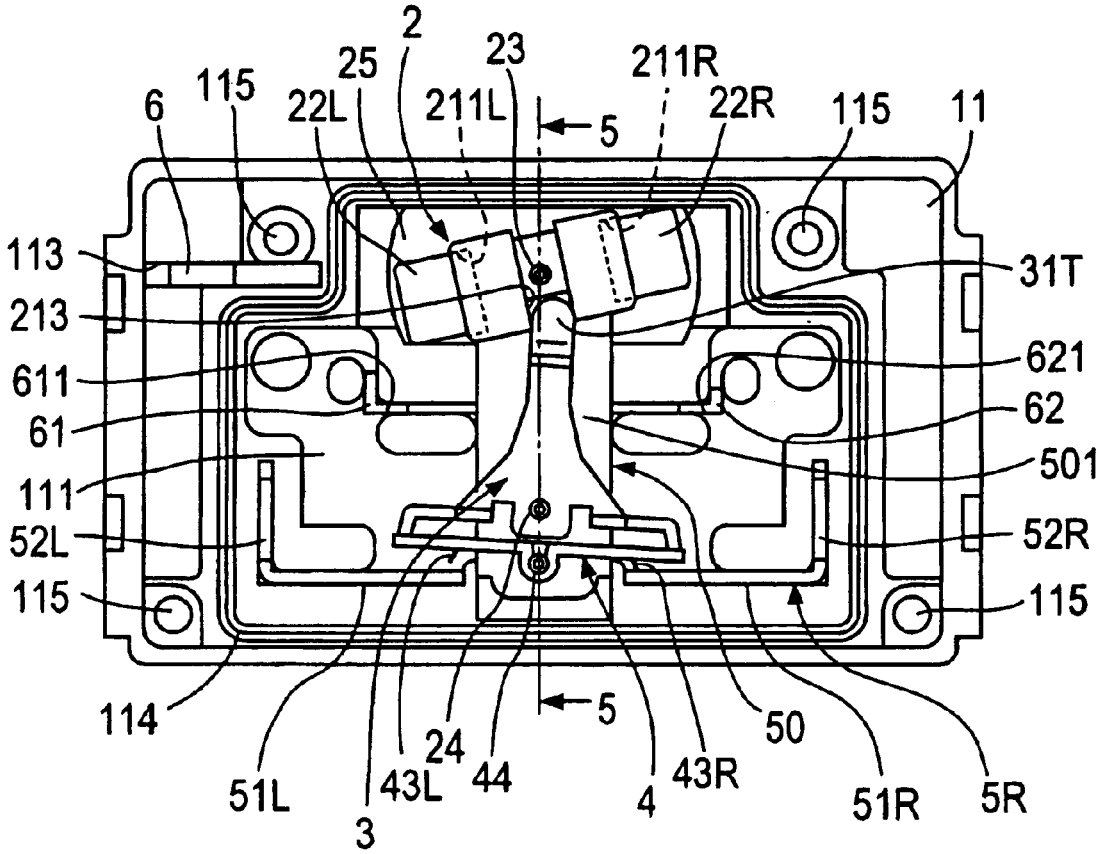
FIG. 4 is a plan view showing an embodiment of the magnetic sensor switch according to the present invention with the cover removed.
Figure 5:
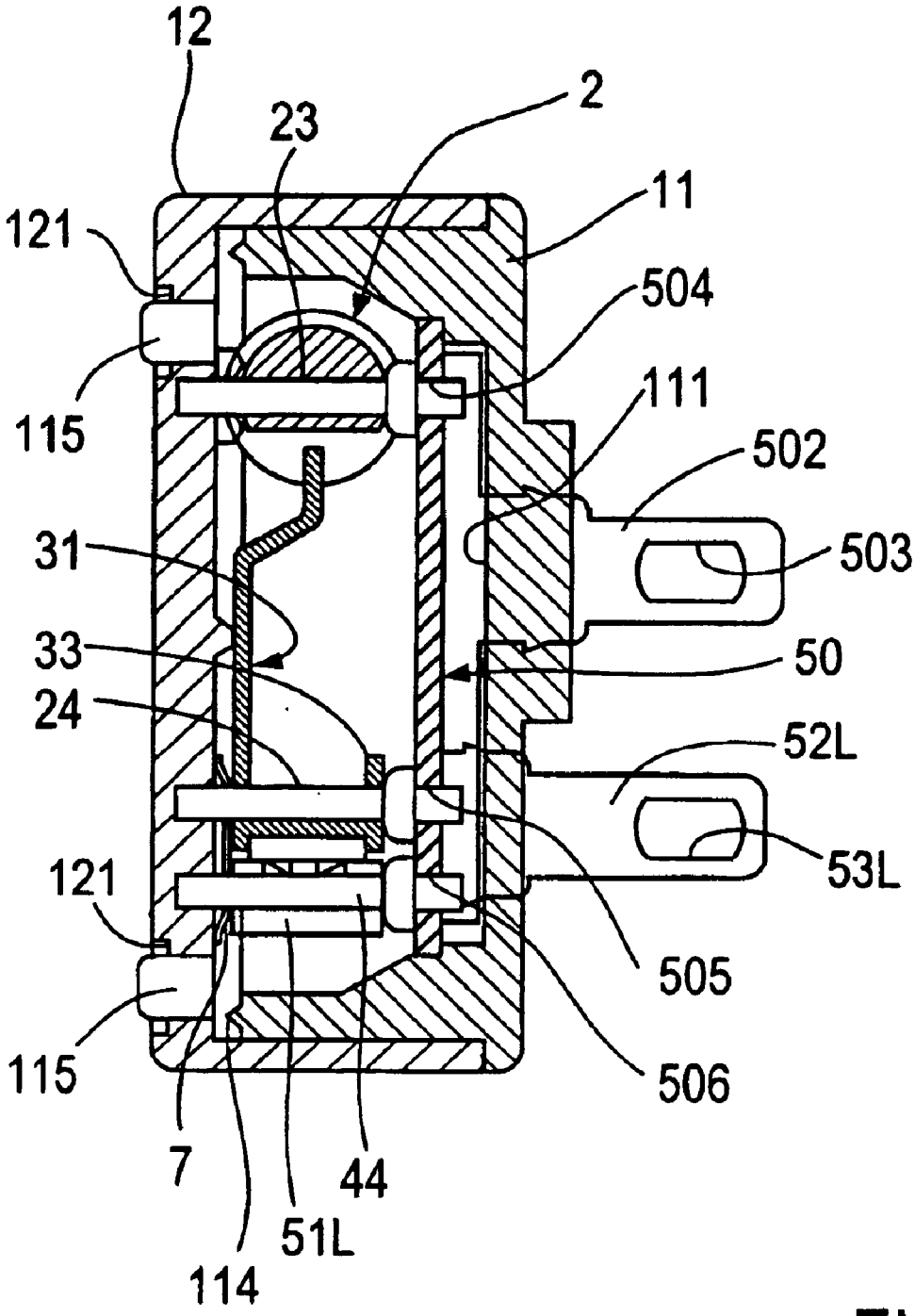
FIG. 5 is a sectional view of the magnetic sensor switch shown in FIG. 4 taken along the line 5—5 in FIG. 4 and looking in the direction indicated by the arrows.

FIG. 4 is a plan view showing an embodiment of the magnetic sensor switch according to the present invention with the cover removed, and FIG. 5 is a sectional view of the magnetic sensor switch shown in FIG. 4 taken along the line 5—5 in FIG. 4 and looking in the direction indicated by the arrows, but FIG. 5 is a sectional view of the magnetic sensor switch with the cover attached. Hence, the cover 12 is shown in FIG. 5.

The magnetic sensor switch comprises a cylindrical magnetic sensor 2 that is rotatable in clockwise and counter-clockwise directions, a driving member 3 that is rotatable in response to the movement of the magnetic sensor 2, a movable contact piece 4 that is rotatable in interlocking relation with the driving member 3 and provided with a pair of first and second movable contact blades 43L and 43R opposed to each other in the longitudinal direction of the contact piece 4, a first fixed contact piece 5L adapted to contact with the first movable contact piece 43L of the movable contact piece 4, a second fixed contact piece 5R adapted to contact with the second movable contact piece 43R of the movable contact piece 4, a common contact piece 50 electrically connected with the movable contact piece 4, an auxiliary magnet 6 which will be described in details hereinafter, a first magnetic member 61, and a second magnetic member 62, the magnetic members 61 and 62 also being described in details hereinafter. These component elements (members) are housed in a case 11 made of an electrically insulating material and of generally rectangular shape in plan, in the arrangement as illustrated.

The auxiliary magnet 6 is fitted in an elongated slot 113 of a rectangular cross-section formed in the case 11 in the horizontal direction thereof as viewed in FIG. 4 such that the auxiliary magnet 6 lies generally on an extension of the longitudinal axis of the cylindrical magnetic sensor 2 when the latter is in the horizontal position. The elongated slot 113 extends through one side wall (left side wall as viewed in FIG. 4 in this embodiment) of the case 11, and the auxiliary magnet 6 can move along the slot 113 for adjusting the position thereof. It is to be noted that the slot 113 is shaped to mate with the sectional shape of the auxiliary magnet 6. Hence, the shape of the slot 113 is determined depending on the sectional shape of the auxiliary magnet 6.

The polarity of the auxiliary magnet 6 is configured in the embodiment illustrated such that the upper end face of the auxiliary magnet 6 as viewed in FIG. 4 is polarized as the N magnetic pole whereas the lower end face of the auxiliary magnet 6 as viewed in FIG. 4 is polarized as the S magnetic pole. As a result, the auxiliary magnet 6 acts to hold the magnetic sensor 2 in a stable stationary position during the stand-by state, as will be explained hereinafter.

A rib 114 is formed on the top end face of the generally convex-shaped housing compartment of the case 11 for accommodating the components except the auxiliary magnet 6 around its entire periphery. The case 11 further has four bosses 115 formed integrally therewith and extending upwardly therefrom at the outer four corners of the housing compartment. Further, as will be appreciated from FIG. 5, the cover 12 fitted over and secured to the case 11 is formed with four through-holes 121 for receiving the respective bosses 15 therethrough, and the bosses 115 are crimped to the holes 121 respectively. In addition, though not illustrated, a packing made of, for example, a synthetic rubber is inserted between the rib 114 and the cover 12 so that the interior of the housing compartment is hermetically sealed (water-proofed) when the cover 12 is attached to the case 12.

Figure 6A:
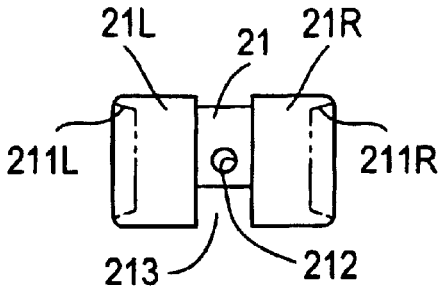
FIG. 6A is a plan view of the magnetic sensor and FIG. 6B is a sectional view of FIG. 6A.
Figure 6B:
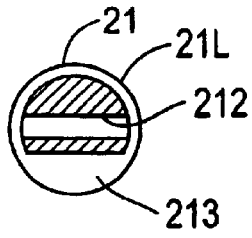

As shown in FIG. 6, the magnetic sensor 2 comprises a solid central, generally cylindrical body 21 formed out of a magnetic substance, first and second magnet holding solid cylindrical bodies 21L and 21R integrally formed on the opposite ends of the central cylindrical body 21, both being formed out of a magnetic substance and being larger in diameter than the central cylindrical body 21, and first and second columnar magnets 22L and 22R (see FIG. 4) secured in first and second magnet mounting recesses 211L and 211R, respectively, which are formed in the cylindrical bodies 21L and 21R, respectively.

The material of the lower peripheral portion (as viewed in the drawing) of the central cylindrical body 21 is horizontally removed to define a recess 213 having a flat bottom surface. As will be described later, the upper end portion 31T of an actuating section 31 of the driving member 3 is inserted in this recess 213 to engage therewith. Further, the central cylindrical body 21 has a bearing hole 212 formed therethrough generally at the longitudinal middle point thereof lying on the axis passing through the centers of the first and second cylindrical sections 21L and 21R, the bearing hole 212 being formed in the direction perpendicular to the plane of the drawing. The bearing hole 212 rotatably receives a rotary shaft 23 mounted to the common contact piece 50, thereby to rotatably support the magnetic sensor 2 constructed as described above.

Figure 7A:
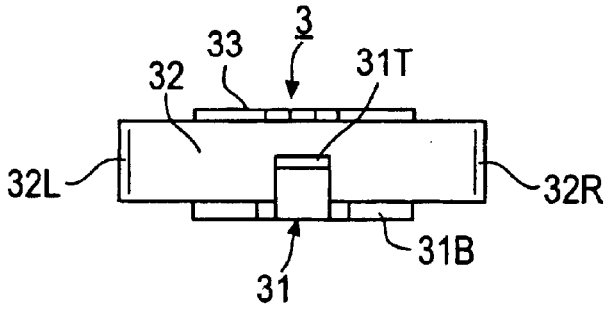
FIG. 7A is a top view of the lever.
Figure 7B:
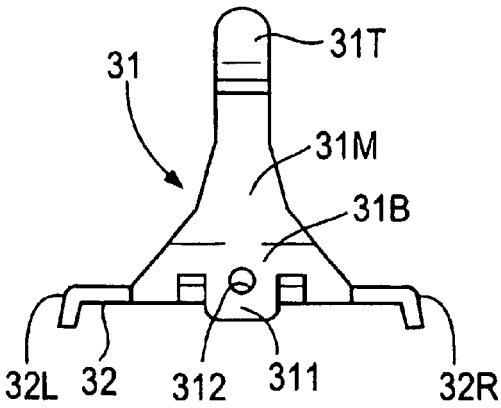
FIG. 7B is a front view of FIG. 7A
Figure 7C:
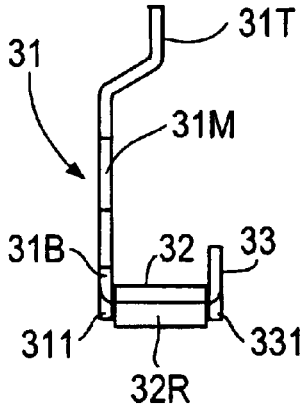
FIG. 7C is a right-hand side view of FIG. 7B.

As shown in FIG. 7, the driving member 3 comprises a movable contact piece driving section 32 in the form of a horizontally extending elongated plate, and the actuating section 31 formed integrally with the driving section 32 and extending upwardly from one lateral side edge of the driving section 32 in the middle thereof. The movable contact piece driving member 3 may be formed by processing a sheet metal, for example. The actuating section 31 includes an extension 33 of a predetermined length upstanding from the other opposite lateral side edge in the middle of the movable contact piece driving section 32. In addition, the base portion 31B of the actuating section 31 and the extension 33 having generally the same shape with the base portion 31B have a generally rectangular tongues 311 and 331, respectively, depending downwardly therefrom. The tongues 311 and 331 have aligned bearing holes 312 formed therethrough in the direction perpendicular to the plane of the drawing. These bearing holes 312 rotatably receive a rotary shaft 24 mounted to the common contact piece 50, thereby to rotatably support the driving member 3 constructed as described above.

In addition, the actuating section 31 is bent between the intermediate portion 31M and the upper end portion 31T thereof such that the upper end portion 31T lies above the center of the driving section 32. Further, the tip end of the upper end portion 31T is formed in the shape of a circular arc so as to insure that the movement of the magnetic sensor 2 is transmitted to the movable contact piece 4. The opposite end portions 32L and 32R of the movable contact piece driving section 32 depend downwardly respectively such that when the driving member 3 is accommodated in the case 11, the lower ends of the depending portions are brought into contact with the upper surface of the movable contact piece 4, whereby the movement of the driving member 3 is transmitted to the movable contact piece 4.

Figure 8A:
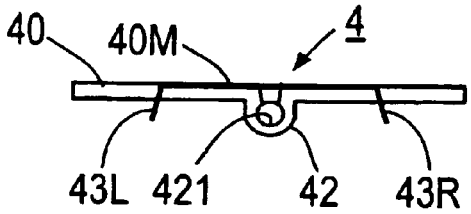
FIG. 8A is a plan view of the movable contact piece.
Figure 8B:
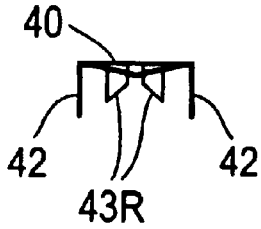
FIG. 8B is a right-hand side view of FIG. 8A
Figure 8C:
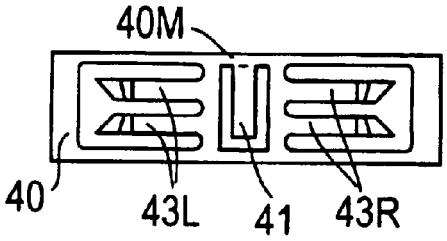
FIG. 8C is a top view of FIG. 8A.

As shown in FIG. 8, the movable contact piece 4 comprises an elongated electrically conductive plate-like member 40 of a rectangular shape in a plan view, an elongated tongue 41 formed in the central portion 40M of the plate-like member 40 transversely thereof, first two elongated tongues 43L and second two elongated tongues 43R formed in the regions adjoining the central portion 40M of the plate-like member 40 on the opposite sides thereof respectively and extending in opposite directions longitudinally of the plate-like member 40, and generally circular depending portions 42 depending from the opposite side edges of the central portion 40M of the plate-like member 40.

The generally circular depending portions 42 have aligned bearing holes 421 formed therethrough in the direction perpendicular to the plane of the drawing, respectively. These bearing holes 421 rotatably receive a rotary shaft 44 mounted to the common contact piece 50, thereby rotatably supporting the movable contact piece 4 constructed as described above.

Further, it should be noted that in this embodiment the first and second elongated tongues 43L and 43R have their outer free end portions bent downwardly such that the first two elongated tongues 43L function as first contact blades to be brought into contact with the upper surface of the first fixed contact piece 5L while the second two elongated tongues 43R function as the second contact blades to be brought into contact with the upper surface of the second fixed contact piece 5R. Thus, the tongues 43L and 43R are referred to as contact blades in this specification.

The first fixed contact piece 5L and the second fixed contact piece 5R are located at positions symmetrical about the vertical central line of the housing compartment of the case 11 as viewed in FIG. 4 in the lower portion of the housing compartment also as viewed in FIG. 4. These first and second fixed contact pieces 5L and 5R are electrically conductive plate-like members of generally L-shape in a plan view, and comprise horizontally (as viewed in FIG. 4) disposed contact portions 51L and 51R and vertically (as viewed in FIG. 4) disposed terminal portions 52L and 52R, respectively. As the first and second fixed contact pieces 5L and 5R are substantially of identical configuration and structure, only the first fixed contact piece 5L will be further described with reference to FIG. 9.

Figure 9A:
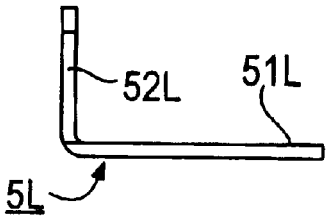
FIG. 9A is a plan view of the one fixed contact piece.
Figure 9B:
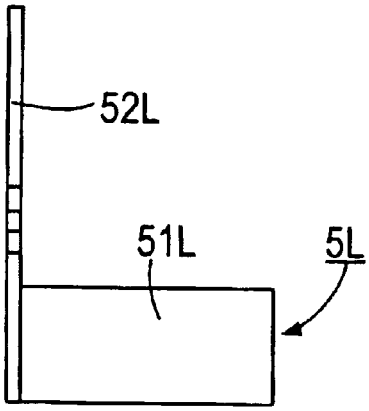
FIG. 9B is a top view of FIG. 9A
Figure 9C:
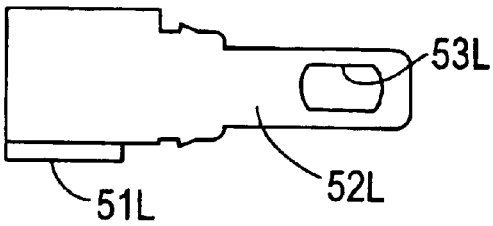
FIG. 9C is a right-hand side view of FIG. 9A.

As shown in FIG. 9, the contact portion 51L and terminal portion 52L of the first fixed contact piece 5L are integrally formed such that the planes of the two are normal to each other. The contact portion 51L is a generally rectangular plate-like member with the surface of which the contact blades 43L of the movable contact piece 4 are brought into contact. The terminal portion 52L is folded at a right angle from one of the minor side edges of the contact portion 51L. When the fixed contact piece 5L is housed in the case 11, the tip portion (end portion having an opening 53L for wire connection) of the terminal portion 52L is press fitted in a narrow L-shaped slot formed through the bottom wall 111 (see FIGS. 4 and 5) of the case 11 and secured thereto with the tip portion projecting through the bottom wall 111 out of the case 11 in the state shown in FIG. 5.

The common contact piece 50 comprises an elongated electrically conductive plate-like contact portion 501 of a generally rectangular shape in a plan view and a terminal portion 502 folded at a substantially right angle from the contact portion 501. The contact portion 501 is vertically disposed as viewed in FIG. 4 generally in the center of the case 11 behind the actuating section 31 of the driving member 2 while the terminal portion 502 is provided with an opening 503 for wire connection formed in the tip portion (free end portion) thereof. When the common contact piece 50 is housed in the case 11 with its contact portion 501 securedly fitted in recesses formed in the bottom wall 111 of the case 11, the terminal portion 502 is press fitted and secured in a narrow slot formed through the bottom wall 111 of the case 11 and secured thereto with the tip portion projecting through the bottom wall 111 out of the case 11 in the state shown in FIG. 5.

Formed through the elongated electrically conductive plate-like contact portion 501 of a generally rectangular shape in plan of the common contact piece 50 at predetermined positions are through-holes 504, 505 and 506 into which the root portions of the rotary shafts 23, 32 and 44 are inserted, respectively. In this embodiment, these through-holes 504, 505 and 506 are formed in the contact portion 501 such that their centers lie on the vertical central line of the case as viewed in FIG. 4.

The first magnetic member 61 is a plate-like piece made of a magnetic substance (an iron plate, for example) having generally L-shape in a plan view, and is located at an appropriate position outside of the rotating radius of the cylindrical magnetic sensor 2 and outside of the region 25 where the cylindrical magnetic sensor 2 is accommodated. The first magnetic member 61 is fitted in and secured to a narrow L-shaped groove 611 formed in the bottom wall 111 of the case 11.

The second magnetic member 62 is a plate-like piece made of a magnetic substance (an iron plate, for example) having generally L-shaped in a plan view, and is located at a position symmetrical with respect to the first magnetic member 61 about the vertical central line as viewed in FIG. 4 outside of the rotating radius of the cylindrical magnetic sensor 2 and outside of the region 25 where the cylindrical magnetic sensor 2 is accommodated. In short, the first magnetic member 61 is located near the first magnet 22L of the magnetic sensor 2 whereas the second magnetic member 62 is located near the second magnet 22R of the magnetic sensor 2. It should be noted that the second magnetic member 62 is smaller in size than the first magnetic member 61. The second magnetic member 62 is also fitted in and secured to a narrow L-shaped groove 621 formed in the bottom wall 111 of the case 11.

Further, it is to be noted that a resilient ring 7 is interposed between the back side of the cover 12 on one hand and the actuating section 31 of the driving member 3 and the depending portions 42 of the movable contact piece 4 on the other hand as shown in FIG. 5, in order to prevent the base portion 31B of the actuating section 31 of the driving member 3 and the depending portion 42 of the movable contact piece 4 from touching the back side of the cover 12 in case the cover 12 is attached to the case 11.

Next, the process of housing the components described above in the case and assembling the magnetic sensor switch of this embodiment will be described below.

First, the root portions of the rotary shafts 23, 32 and 44 are inserted into the through-holes 504, 505 and 506 of the common contact piece 50 and are crimped thereto. Thereafter, the common contact piece is press-fitted in the slot formed in the bottom wall 11 of the case 11. Then, the auxiliary magnet 6 is fitted in the elongated slot 113 formed in the case 11. Thereafter, the first and second fixed contact pieces 5L and 5R are press-fitted in and secured to the respective slots formed in the bottom wall 111 of the case 11, and further, the cylindrical magnetic sensor 2 is housed in the case 11 by inserting the bearing hole 212 thereof over the rotary shaft 23.

As a next step, the movable contact piece 4 and the driving member 3 are assembled into the case 11 respectively by inserting the bearing holes 421 of the movable contact piece 4 over the rotary shaft 44 and inserting the bearing holes 312 of the actuating section 31 of the driving member 3 over the rotary shaft 24 as well as engaging the upper end portion 31T of the actuating section 31 in the recess 213 provided underneath the central cylindrical body 21 of the cylindrical magnetic sensor 2. Thereafter, the first magnetic member 61 and the second magnetic member 62 are fitted in the grooves formed in the bottom wall 111 of the case 11, respectively. Further, it is to be noted that the sequence of assembling the components is not always limited to the sequence described above.

Following this step, the ring 7 is inserted over the rotary shafts 24 and 44 and positioned in place on the surfaces of the one depending portion 42 of the movable contact piece 4 and the base portion 31B of the actuating section 31 of the driving member 3.

Once the components have been housed in the case 11 in this manner, the cover 12 is fitted over and secured to the case 11 with a packing (not shown) made of a synthetic rubber intervening between the rib 114 and the cover 12. As described hereinbefore, the cover 12 is formed with the through-holes 121 in alignment with the respective bosses 115 of the case 11 for receiving them therethrough. Thus, once the cover 12 has been fitted over the case 11, the cover 12 is strongly pressed onto the case 11 in order to crimp the bosses 115 to the through-holes 121. As a result, the interior of the magnetic sensor is hermetically sealed (waterproofed) by means of the packing made of a synthetic rubber. In such manner, the assembly of the magnetic sensor switch is completed.

In the embodiment as described above, the forward end face of the first magnet 22L of the cylindrical magnetic sensor 2 is polarized as the N magnetic pole whereas the forward end face of the second magnet 22R is polarized as the S magnetic pole. Since the central cylindrical body 21, and the cylindrical bodies 21L and 21R on the opposite ends thereof are magnetic bodies respectively, the cylindrical magnetic sensor 2 acts substantially as one magnet. In addition, since the cylindrical magnetic sensor 2 is accommodated in the cavity region 25 generally cylindrical, but having arcuate inner peripheral surfaces in the upper portion of the case in FIG. 4, the cylindrical magnetic sensor 2 is rotatable only through the same predetermined angles in clockwise and counter-clockwise directions about the rotary shaft 23. When the cylindrical magnetic sensor 2 is housed in the cavity region 25, in the standby state of the magnetic sensor 2 in which there is no magnet outside of the magnetic sensor switch, the magnetic sensor 2 is held in stationary state in which the forward end of the first magnet 22L is abutting against the left-hand lower side wall of the cavity region 25, as shown in FIG. 4, by an attracting force of the S pole of the auxiliary magnet 6 and a repulsive force of the N pole thereof.

While the magnetic sensor 2 is held in stationary state in which the forward end of the first magnet 22L is abutting against the left hand lower side wall of the cavity region 25, as shown in FIG. 4, by the attracting force and the repulsive force of the auxiliary magnet 6, it is held stationary in a further stabled condition by an attracting force of the first magnetic member 61 disposed near the first magnet 22L. Accordingly, in the standby state of the magnetic sensor 2, the magnetic sensor 2 is at rest in a tilted position with the first magnet 22L side being lowered. As the magnetic sensor 2 is rotated in the counter-clockwise direction, the actuating section 31 of the driving member 3 is rotated in the clockwise direction whereby the movable contact piece driving section 32 of the driving member 3 causes the plate-like member 40 of the movable contact piece 4 to rotate in the same clockwise direction. It is thus to be appreciated that in the standby state of the magnetic sensor 2, the second contact blade 43R of the movable contact piece 4 is in contact with the contact portion 51R of the second fixed contact piece 5R.

When the movable contact piece 4 is rotatably mounted on the rotary shaft 44, the elongated tongue 41 of the central portion 40M of the movable contact piece 4 is brought into contact with the rotary shaft 44. Accordingly, the movable contact piece 4 is electrically connected with the common contact piece 50 through the elongated tongue 41 and the rotary shaft 44. Consequently, during the standby state, the terminal portion 52R of the second fixed contact piece 5R is electrically connected with the terminal portion 502 of the common contact piece 50 through the movable contact piece 4 and the contact portion 501 of the common contact piece 50.

Now, the operation of the magnetic sensor switch constructed as described above will be explained.

In the standby state of the magnetic sensor 2, when the S pole of an external magnet approaches the magnetic sensor switch from the upper side thereof as viewed in FIG. 4, the N pole of the first magnet 22L of the magnetic sensor 2 is subjected to a force in the sense that it is attracted to the S pole of the external magnet whereas the S pole of the second magnet 22R is subjected to a force in the sense that it is repulsed from the S pole of the external magnet. As a result, a clockwise rotating force is applied to the magnetic sensor 2.

The instant that the attracting and repulsive forces caused by the S pole of the external magnet exceed the attracting and repulsive forces caused by the auxiliary magnet 6 and the attracting force between the first magnet 22L and the first magnetic member 61 as the S pole of the external magnet further approaches the magnetic sensor switch, the magnetic sensor 2 rotates in the clockwise direction and stops to rotate when the forward end of the second magnet 22R comes to abutment with the right-hand lower side wall of the cavity region 25. That is, when the S pole of the external magnet approaches to a predetermined distance to the magnetic sensor switch, the magnetic sensor 2 rotates and becomes stationary in the tilted state that the second magnet 22R side is lower than the first magnet 22L side. In such case, the attracting force to the first magnet 22L of the magnetic sensor 2 produced by the provision of the first magnetic member 61 is in opposition to the clockwise rotating force of the magnetic sensor 2 produced by the approach of the S pole of the external magnet. Because of this, a clicking action is given to the magnetic sensor 2 when it rotates in the reverse direction, whereby the reversing action of the magnetic sensor 2 can be accelerated.

As the magnetic sensor 2 rotates in the clockwise direction, the actuating section 31 of the driving member 3 is rotated in the counter-clockwise direction whereby the movable contact piece driving section 32 of the driving member 3 causes the plate-like member 40 of the movable contact piece 4 to rotate in the same counter-clockwise direction. Therefore, upon the S pole of the external magnet approaching to a predetermined distance to the magnetic sensor switch, the first contact blade 43L of the movable contact piece 4 comes into contact with the contact portion 51L of the first fixed contact piece 5L. Consequently, at this time the terminal portion 52LR of the first fixed contact piece 5L is electrically connected with the terminal portion 502 of the common contact piece 50 through the movable contact piece 4 and the contact portion 501 of the common contact piece 50.

The instant that the attracting and repulsive forces caused by the S pole of the external magnet drops below the attracting force between the second magnet 22R and the second magnetic member 62 as the S pole of the external magnet moves away from the magnetic sensor switch, the magnetic sensor 2 rotates in the counter-clockwise direction until the forward end of the first magnet 22L comes to abutment with the right-hand lower side wall of the cavity region 25 whereupon the magnetic sensor 2 comes to a standstill. That is, when the S pole of the external magnet moves away beyond a predetermined distance from the magnetic sensor switch, the magnetic sensor 2 rotates and becomes stationary in the tilted state that the first magnet 22L side is lower than the second magnet 22R side. In such case, the attracting force to the second magnet 22R of the magnetic sensor 2 produced by the provision of the second magnetic member 62 is in opposition to the counter-clockwise rotating force of the magnetic sensor 2 produced by that the S pole of the external magnet moves away beyond a predetermined distance. Because of this, a clicking action is given to the magnetic sensor 2 when it rotates in the reverse direction, whereby the reversing action of the magnetic sensor 2 can be accelerated.

As discussed above, it is to be appreciated that since the magnetic sensor 2 acts, in response to that the S pole of the external magnet approaches and leaves it, to instantaneously rotate in the clockwise or counter-clockwise direction, the contact blades 43L and 43R of the movable contact piece 4 may be quickly and positively switched into contact with the corresponding fixed contact pieces 5L and 5R respectively by transmitting the rotating movement of the magnetic sensor 2 to the movable contact piece 4 through the driving member 3. In addition, since the magnetic sensor 2 acts only when a particular magnetic pole of a magnet approaches it, the magnetic sensor switch exhibits an excellent sensitivity, and hence its reliability can be enhanced. Moreover, this magnetic sensor switch provides the additional advantages of the reduced cost of manufacture and yet the reduced maintenance cost, because it does not utilize a switch in which a magnetic field is applied directly to the contact portions thereof such as a reed switch.

It should here be noted that as noted above, the polarity of the auxiliary magnet 6 is configured such that the upper end portion thereof as viewed in FIG. 4 is polarized as the N pole whereas the lower end portion thereof is polarized as the S pole. The auxiliary magnet 6 provides to the first magnet 22L of the magnetic sensor 2 a magnetic attracting force and a magnetic repulsive force causing the magnetic sensor 2 to rotate in the counter-clockwise direction, thereby to hold the magnetic sensor 2 in the stationary position shown in FIG. 4. As will be appreciated, since the attracting and repulsive forces of the auxiliary magnet 6 are varied by adjusting the position of the auxiliary magnet 6, the detection distance of the S pole of the external magnet when it approaches the magnetic sensor may be adjusted.

On the other hand, there is formed a magnetic circuit between the first magnet 22L and the first magnetic member 61. Accordingly, the detection distance of the S pole of the external magnet when it approaches the magnetic sensor may be finely adjusted by adjusting the position of the auxiliary magnet 6 in the elongated slot 113 in a direction toward or away from the first magnet 22L. More specifically, if the auxiliary magnet 6 is shifted in its position in the elongated slot 113 in the direction toward the first magnet 22L, the attracting force of the magnetic sensor 2 to the first magnet 22L is increased, whereby the detection distance of the external magnet when it approaches may be shortened. Conversely, if the auxiliary magnet 6 is shifted in its position in the elongated slot 113 in the direction away from the first magnet 22L, the attracting force of the magnetic sensor 2 to the first magnet 22L is reduced, whereby the detection distance of the external magnet when it approaches may be lengthened.

Further, in the embodiment as described above, the construction, configuration, shapes and dimensions of the magnetic sensor 2, the driving member 3, the movable contact piece 4, the first and second contact blades 43L and 43R of the movable contact piece, the first and second fixed contact pieces 5L and 5R, the common contact piece 50, the auxiliary magnet 6, the first and second magnetic members 61 and 62, etc. are illustrated only by way of example, and it should be understood that those may be modified and/or changed in various manners as required. Moreover, it will be apparent to those skilled in the art that the mounting locations of the auxiliary magnet 6, and the first and second magnetic members 61 and 62, etc. are not limited to those illustrated in the embodiment. In addition, the polarities of the first and second magnets 22L and 22R of the magnetic sensor 2 and the auxiliary magnet 6 are not limited to those illustrated in the embodiment. The magnetic sensor 2 may be configured as one cylindrical bar magnet having the N magnetic pole at one end portion thereof and the S magnetic pole at the other end portion thereof.

As will be apparent from the foregoing description, according to the present invention, the magnetic sensor switch is configured such that the magnetic sensor acts, in response to that an external magnet approaches and leaves it, to instantly rotate in the clockwise or counter-clockwise direction, whereby the contact blades of the movable contact piece may be switched into contact with the corresponding one of the fixed contact pieces. Accordingly, the changeover of the magnetic sensor switch may be quickly and positively effected. Moreover, since the clicking action is added to the magnetic sensor by provision of the first and second magnetic members, rotating movement of the magnetic sensor is momentarily arisen and hence the changeover of the magnetic sensor switch may be instantly made. Further, it is possible to finely adjust the detection distance of an external magnet when it approaches the magnetic sensor. Therefore, the reliability of the magnetic sensor switch may be enhanced. In addition, this magnetic sensor switch introduces the additional advantages of the reduced cost of manufacture and on top of that the reduced maintenance cost, because it does not utilize a switch that has the contact portions to which a magnetic field is directly applied such as a reed switch.

While the present invention has been described with regard to the preferred embodiment shown by way of example, it will be apparent to those skilled in the art that various modifications, alterations, changes, and/or minor improvements of the embodiment described above can be made without departing from the spirit and the scope of the present invention. Accordingly, it should be understood that the present invention is not limited to the illustrated embodiment, and is intended to encompass all such modifications, alterations, changes, and/or minor improvements falling within the scope of the invention defined by the appended claims.

What is claimed is:

1. A magnetic sensor switch comprising:

an elongated magnetic sensor having magnetic poles contrary to each other at opposite ends thereof and mounted for rotation through predetermined angles in clockwise and counter-clockwise directions;

a movable contact piece including a pair of contact blades;

a pair of fixed contact pieces located in opposition to said pair of contact blades of said movable contact piece, respectively;

a common contact piece electrically connected to the movable contact piece;

a driving member transmitting the movement of said magnetic sensor to the movable contact piece;

an auxiliary magnet located on a longitudinal extension line of the magnetic sensor and mounted such that it can be moved toward and away from one of the magnetic poles of the magnetic sensor;

a first magnetic member located at a predetermined position outside of the rotating radius of the magnetic sensor and in the vicinity of said one magnetic pole; and a second magnetic member located at a predetermined position outside of the rotating radius of the magnetic sensor and in the vicinity of the other magnetic pole.

2. The magnetic sensor switch as set forth in claim 1, wherein said magnetic sensor is a generally cylindrical member comprising a cylindrical central body made of a magnetic substance, a first magnet affixed to said cylindrical central body at one of the opposite ends thereof, and a second magnet affixed to said cylindrical central body at the other of the opposite ends thereof;

said driving member comprising a movable contact piece driving section in the form of an elongated plate, and an actuating section formed integrally with said movable contact piece driving section and extending upwardly from one lateral side edge of the middle portion of the movable contact piece driving section;

said movable contact piece comprising an elongated electrically conductive plate-like member of a rectangular shape in a plan view, a tongue formed transversely in the central portion of said plate-like member, first and second contact blades formed in the longitudinal direction of the plate-like member in the opposite side regions adjoining said central portion of the plate-like member and extending in the opposite directions to each other, and generally circular depending portions depending from the opposite side edges of the central portion of the plate-like member;

each of said fixed contact pieces comprising a contact portion adapted to contact with the corresponding contact blade of the movable contact piece and a terminal portion formed integrally with and folded from said contact portion; and said common contact piece comprising an elongated plate-like contact portion and a common terminal portion formed integrally with and folded from said contact portion, said contact portion of the common contact piece being formed with through-holes into which rotary shafts for rotatably supporting said magnetic sensor, said driving member, and said movable contact piece should be inserted, respectively.

3. The magnetic sensor switch as set forth in claim 1, wherein said magnetic sensor is a generally cylindrical magnet having N magnetic pole at one of the opposite ends thereof and S magnetic pole at the other of the opposite ends thereof;

said driving member comprising a movable contact piece driving section in the form of an elongated plate, and an actuating section formed integrally with said movable contact piece driving section and extending upwardly from one lateral side edge of the middle portion of the movable contact piece driving section;

said movable contact piece comprising an elongated electrically conductive plate-like member of a rectangular shape in a plan view, a tongue formed transversely in the central portion of said plate-like member, first and second contact blades formed in the longitudinal direction of the plate-like member in the opposite side regions adjoining said central portion of the plate-like member and extending in the opposite directions to each other, and generally circular depending portions depending from the opposite side edges of the central portion of the plate-like member;

each of said fixed contact pieces comprising a contact portion adapted to contact with the corresponding contact blade of the movable contact piece and a terminal portion formed integrally with and folded from said contact portion; and said common contact piece comprising an elongated plate-like contact portion and a common terminal portion formed integrally with and folded from said contact portion, said contact portion of the common contact piece being formed with through-holes into which rotary shafts for rotatably supporting said magnetic sensor, said driving member, and said movable contact piece should be inserted, respectively.

4. The magnetic sensor switch as set forth in claim 1, wherein said auxiliary magnet acts such that it provides an attracting force and a repulsive force to said one magnetic pole of said magnetic sensor to rotate the magnetic sensor through the predetermined angle in one direction, thereby to hold the magnetic sensor in standby position in which it is stationary at an inclined position tilted from the horizontal position; and said first and second magnetic members acting to provide attracting forces to the corresponding magnetic poles of the magnetic sensor thereby to impart an instantaneous snapping force to the magnetic sensor when the magnetic sensor rotates in a reverse direction.

* * * * *